US006314264B1

(12) United States Patent
Iida et al.

(10) Patent No.: US 6,314,264 B1
(45) Date of Patent: Nov. 6, 2001

(54) IMAGE FORMING APPARATUS

(75) Inventors: Kenichi Iida, Shizuoka-ken; Yasuo Yoda; Tomoaki Nakai, both of Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/492,334

(22) Filed: Jan. 27, 2000

(30) Foreign Application Priority Data

Jan. 28, 1999 (JP) ..... 11-020233
Jan. 19, 2000 (JP) ..... 12-009857

(51) Int. Cl.[7] ..... G03G 15/16
(52) U.S. Cl. ..... 399/302; 399/299; 399/308
(58) Field of Search ..... 399/302, 308, 399/299, 306

(56) References Cited

U.S. PATENT DOCUMENTS 5,585,905 * 12/1996 Mammino et al. .
6,042,917 * 3/2000 Schlueter et al. ..... 428/60
6,088,565 * 7/2000 Jia et al. ..... 399/302

* cited by examiner

*Primary Examiner*—William J. Royer
(74) *Attorney, Agent, or Firm*—Fitzpatrick, Cella, Harper & Scinto

(57) ABSTRACT

An image forming apparatus includes a plurality of image bearing members for bearing images; and an intermediate transfer member onto which a plurality of images on the plurality of image bearing members is sequentially transferred electrostatically at a plurality of transfer positions, the plurality of images on the intermediate transfer member is transferred onto a recording material, wherein a relationship of $\tau \leqq T$ is satisfied in which T (second) is a time taken in order for the intermediate transfer member to move from one transfer position to an adjacent transfer position when a plurality of images is transferred from the plurality of image bearing members onto the intermediate transfer member, and $\tau$ (second) is a charge relaxation time of the intermediate transfer member.

13 Claims, 5 Drawing Sheets

IMAGE FORMING APPARATUS

BACKGROUND OF THE INVENTION

1. Field of the Invention

The present invention relates to, for example, an image forming apparatus such as a copy device, a printer or a facsimile, and more particularly to such an image forming apparatus that transfers an image on an image bearing member onto an intermediate transfer member and then transfers the image on the intermediate transfer member onto a transfer material.

2. Description of the Related Art

Heretofore, there is known such an image forming apparatus that transfers a toner image formed on an image bearing member using an electrophotographic technique onto a recording material and then fixes that unfixed toner image in order to obtain a permanent image on the recording material. Such apparatus is more widely used as a color-image forming apparatus as society has become more information oriented in recent years.

FIG. 5 shows an outline configuration of one example of a conventional electrophotographic full-color image forming apparatus. To accelerate a speed of outputting color images, this image forming apparatus has in itself a plurality of photosensitive members (i.e., image bearing members), each of which is used to form toner images sequentially, which are once multi-transferred on an intermediate transfer member and then transferred onto a recording material collectively.

As shown in FIG. 5, the present image forming apparatus has four image forming sections (image forming stations) of 10Y, 10M, 10C, and 10K for four colors of yellow, magenta, cyan, and black respectively and also an intermediate transfer belt 80 as transfer means and a fixing device 40 as fixing means.

The image forming sections 10Y, 10M, 10C, and 10K are each provided as a unit, together with photosensitive drums as image bearing members 70Y, 70M, 70C, and 70K respectively, around which are respectively arranged primary charging rollers 12Y, 12M, 12C, and 12K; laser exposure devices 13Y, 13M, 13C, and 13K; developing devices 14Y, 14M, 14C, and 14K; primary transfer rollers 54Y, 54M, 54C, and 54K; and cleaners 16Y, 16M, 16C, and 16K. The intermediate transfer belt 80 is disposed in contact with each of the photosensitive drums 70Y through 70K and stretched over three rollers of a drive roller 51, a tension roller 52, and a secondary transfer opposed roller 53, thus being driven in rotation in the direction indicated by an arrow b in the figure.

The photosensitive drums 70 (70Y–70K) are each uniformly charged on their surface by the primary charging rollers 12 (12Y–12K), to subsequently expose a color-separated image to light using the laser exposure devices 13 (13Y–13K), in order to form on the surface of the photosensitive drums 70 an electrostatic latent image which corresponds to an original. This latent image is developed by the developing devices 14 (14Y–14K) using minus toner, to form a toner image on the surface of the photosensitive drums 70.

The above-mentioned image forming operations are performed on each of the image forming sections 10Y through 10K at their respective predetermined timing points, thereby forming various colors of toner images on the photosensitive drums 70. These various colors of toner images are sequentially transferred onto the intermediate transfer belt 80 at each of the primary transfer sections opposed to the primary transfer rollers 54 (54Y–54K) (primary transfer), to once form on the intermediate transfer belt 80 a full-color image in which those four colors (yellow, magenta, cyan, and black) of toner images are superposed on top of each other.

Then, these four colors of toner images are collectively transferred using a secondary transfer roller 55 onto a recording material P fed at predetermined timing by a feed roller 20 (secondary transfer). The recording material P as finished by this transfer process is conveyed to the fixing device 40, where it is heated and pressured to fix the toner images.

As mentioned above, the full-color image forming apparatus with an intermediate transfer member collectively transfers four colors of toner images on the intermediate transfer member onto a recording material, thus being excellent in that it produces less misregister in color (color registration). Also, in contrast to a system that absorbs a recording material on a recording material bearing member such as for example a transfer belt or transfer drum and then conveys the material, to directly transfer onto the material each color of toner images formed on a photosensitive drum and superpose these toner images on the recording material, this system of using an intermediate transfer member need not absorb or convey the recording material but only needs to collectively transfer onto the recording material full-color toner images formed by rotating the intermediate transfer member such as for example an intermediate transfer belt, thus forming images regardless of the kind of recording material, such as an envelope, cardboard, etc., with no variations in color registration due to the thickness of the recording material employed.

For this reason, therefore, particularly such an image forming apparatus using an intermediate transfer member is widely used for the electrophotographic-type full-color image forming apparatuses.

The above-mentioned primary transfer system, however, usually needs complicated transfer bias control. To achieve good transferability in all of the image forming sections 10Y through 10K, larger constant-voltage biases must be set at more downstream side image forming sections to give a sufficient transfer current to all the image forming sections, thus making it necessary to apply transfer biases from a total of four high-tension power supplies each independently for each of the image forming sections.

This is because the intermediate transfer belt is gradually charged up as it sequentially passes the image forming sections so that various colors of toner images may be superposed and transferred thereon, thus causing effective impedance in the width direction of the intermediate transfer belt passing the transfer nip sections to be increased as the belt passes more downstream side image forming sections.

SUMMARY OF THE INVENTION

It is an object of the present invention to provide an image forming apparatus capable of preferably forming an image on an intermediate transfer member without the intermediate transfer member being charged up.

The other objects of the present invention will be better understood upon reading of the following detailed description.

DETAILED DESCRIPTION OF THE PREFERRED EMBODIMENTS

The following will describe in detail the embodiments of the present invention with reference to the drawings.

First Embodiment

Figure 1:
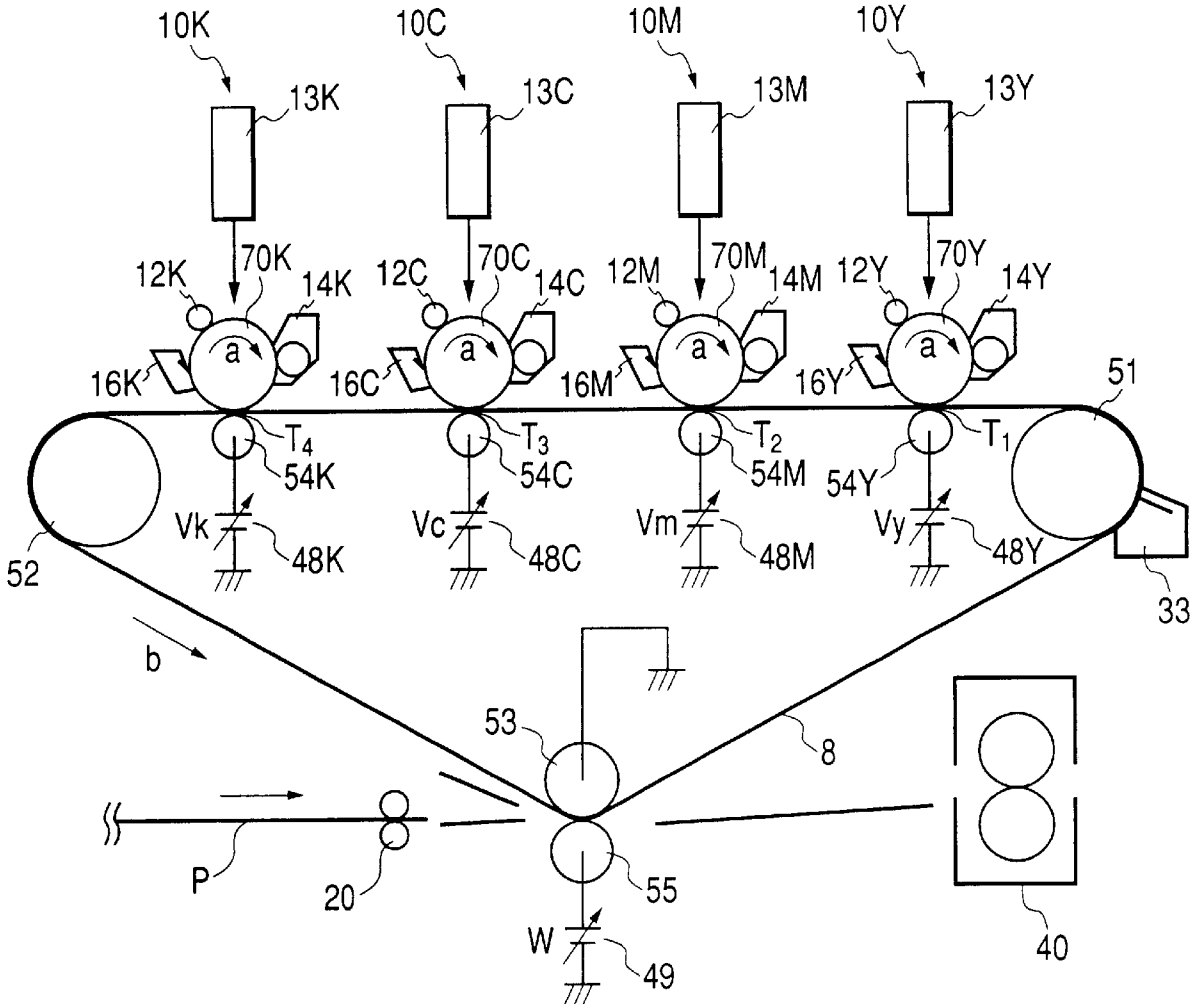
FIG. 1 is a schematic configuration diagram showing an embodiment of an image forming apparatus according to the present invention.

FIG. 1 is a schematic configuration diagram showing an embodiment of an image forming apparatus according to the present invention. The image forming apparatus is configured in an intermediate transfer-system full-color printer using four photosensitive drums.

As shown in FIG. 1, the image forming apparatus comprises: four image forming sections (image forming stations) 10Y, 10M, 10C, and 10K respectively for four colors of yellow (Y), magenta (M), cyan (C), and black (K); an intermediate transfer belt 8 as the intermediate transfer member; and a fixing device 40 as the fixing means.

The image forming sections 10Y, 10M, 10C, and 10K are each given as a unit and the corresponding image bearing members, i.e. photosensitive drums 70Y, 70M, 70C, and 70K are arranged as being rotational in the direction of an arrow a. These photosensitive drums 70Y, 70M, 70C, and 70K have primary charging rollers 12Y, 12M, 12C, and 12K arranged on their respective circumferences and laser exposure devices 13Y, 13M, 13C, and 13K arranged on their respective downstream sides in their rotational direction, which devices 13Y through 13K expose the photosensitive drums 70Y through 70K to their own emitted laser beam modulated in correspondence to an image signal. On the further downstream sides are arranged developing devices 14Y, 14M, 14C, and 14K containing yellow toner, magenta toner, cyan toner, and black toner.

Opposed to these photosensitive drums 70Y, 70M, 70C, and 70K, with the intermediate transfer belt 8 positioned therebetween, are arranged primary transfer rollers 54Y, 54M, 54C, and 54K, to which are applied primary transfer biases Vy, Vm, Vc, and Vk by high-tension power supplies (constant-voltage supplies) 48Y, 48M, 48C, and 48K respectively.

The intermediate transfer belt 8 is disposed in contact with the photosensitive drums 70Y through 70K of the image forming units 10Y through 10K respectively and stretched over three rollers of a drive roller 52, a tension roller 51, and a secondary transfer opposed roller 53, to be driven in rotation in the direction of an arrow b in the figure.

Note here that such a configuration may be employed that the intermediate transfer belt 8 would be swung and spaced so as to come in contact with only a desired photosensitive drum in a mono-color mode for, for example, forming monochromatic images. Also, such another configuration may be employed that the intermediate transfer belt 8 would be spaced from all of the photosensitive drums in a stand-by mode where an image forming signal is yet to be input.

Also, on the downstream sides of the photosensitive drums 70Y, 70M, 70C, and 70K are arranged cleaners 16Y, 16M, 16C, and 16K respectively, while the intermediate transfer belt 8 is configured to come in contact with a belt cleaner 33 at the tension roller 51.

The operations of the above-mentioned image forming apparatus will be described taking the yellow image forming unit 10Y as an example.

The photosensitive drum 70Y has a photo-conductive layer formed on a surface of its cylindrical member made of aluminum, so that as being rotated in the direction indicated by the arrow a, the drum 70 is uniformly charged negative at about −500V on its surface by the primary charging roller 12Y and then undergoes image exposure at the laser exposure device 13Y, to form on its surface an electrostatic latent image, corresponding to an original, which consists of a highlight (laser-exposed portion with a potential of −200V) and a shadow (non-exposed portion with a potential of −500V). This latent image is developed by the developing device 14Y using yellow toner charged negative, to form a yellow-toner image on the surface of the photosensitive drum 70Y. The yellow-toner image thus formed on the photosensitive drum 70Y is transferred onto the intermediate transfer belt 8 by the primary transfer roller 54Y (primary transfer). The photosensitive drum 70Y immediately after transfer is cleared of transfer-residual toner left on the surface by the cleaner 16Y in preparation for the next image forming process.

The above-mentioned operations are performed at predetermined timing by each of the image forming units 10Y through 10K, to sequentially superpose and transfer various colors of toner images onto the intermediate transfer belt 8 at the primary transfer section comprising the photosensitive drums 70Y through 70K and the primary transfer rollers 54Y through 54K.

In the full-color mode, yellow, magenta, cyan, and black toner images are transferred in this order onto the intermediate transfer belt 8, while in the mode for a single, two, or three colors also, required colors of toner images are transferred in the same order as above.

Then, as the intermediate transfer belt 8 is rotated in the direction indicated by the arrow b, the four colors of toner images are moved to a secondary transfer section consisting of a secondary transfer roller 55 and a grounded secondary transfer opposed roller 53, to be collectively transferred onto a recording material P fed from a feed roller 20 at predetermined timing by the secondary transfer roller 55 to which is applied a secondary bias W by a high-tension power supply (constant-voltage supply) 49 (secondary transfer). Upon completion of the secondary transfer, the intermediate transfer belt 8 is cleaned on its surface by the belt cleaner 33.

In this embodiment, as each of the photosensitive drums 70Y through 70K, a negative-charging OPC drum with a diameter of 30.6 mm is employed, so that a charging bias obtained by superposing an AC component on a DC component is applied to the charging rollers 12Y through 12K, thus uniformly charging the photosensitive drums 70Y through 70K at about −550V regardless of differences in the environment. The exposure devices 13Y through 13K each have a near-infra red laser diode with a wavelength of 760 nm and a polygon scanner for scanning the photosensitive drums 70Y through 70K with a laser beam.

The yellow developing device 14Y, the magenta developing device 14M, the cyan developing device 14C, and the black developing device 14K are each of a jumping developing type by use of non-magnetic mono-component toner, such that as the toner, wax-containing, core/shell structured negative-charging polymer toner with a particle diameter of 6 μm is employed and applied on a development sleeve to be regulated in terms of its toner thickness by an elastic blade and then jumped, for reversal development, onto an electrostatic latent image on the respective photosensitive drums 70Y, 70M, 70C, and 70K.

Each of the primary transfer rollers 54Y through 54K, the secondary transfer roller 55, and the secondary transfer opposed roller 53 is made of a metal core with a diameter of 14 mm which is coated with a conductive rubber layer with a volume resistivity of $1\times10^5$ Ωcm as long as 310 mm in the longitudinal direction so as to provide its roller diameter of 20 mm. The primary transfer rollers 54Y through 54K have their respective metal core sections connected via feeder springs to the high-tension power supplies 48Y through 48K respectively; the secondary transfer roller 55 has its metal core section connected to the high-tension power supply 49; and the secondary transfer opposed roller 53 has its metal core section connected to the ground.

In the configuration of the embodiment, the distance between the mutually adjacent two photosensitive drums (i.e. between the mutually adjacent two primary transfer sections) is approximately the same as the circumferential length of the drive roller 52, which should preferably be a fixed value taking into account a thickness of the intermediate transfer belt if the thickness cannot be disregarded as compared to the radius of the drive roller 52. Not only in such a configuration but also in any configuration, the distance between the mutually adjacent two primary transfer members mentioned above only needs to be an integer multiple of the circumferential length of the drive roller. By providing such a configuration, it is possible to prevent misregister in color due to irregularities in the speed of the intermediate transfer belt caused by eccentricity etc. of the drive roller.

Note here that the present invention has a major feature in that self-attenuation type electric characteristics are provided to the intermediate transfer belt 8, which has a circumferential length of 1115 mm and a width-direction length (i.e., length in the same direction as the longitudinal direction of the photosensitive drum) of 310 mm.

In the case of the present invention, "self-attenuation type" means that the following relationship is met:

$$\tau \leqq T$$

where τ is a charge relaxation time of the intermediate transfer member, and T is a time taken for a portion of the intermediate transfer member to move over a distance between the mutually adjacent two image bearing members (the mutually adjacent two of the primary transfer members, i.e. $T_1$ and $T_2$, $T_2$ and $T_3$, or $T_3$ and $T_4$). The type that does not meet this relationship, on the other hand, is referred to as charge-up type.

The charge relaxation time of an intermediate transfer belt, τ, is defined as a time taken in order for a given potential V to lower to V/e (e, the base of natural logarithm, =2.718 . . . ) at a charge position on the intermediate transfer belt.

Figure 4:
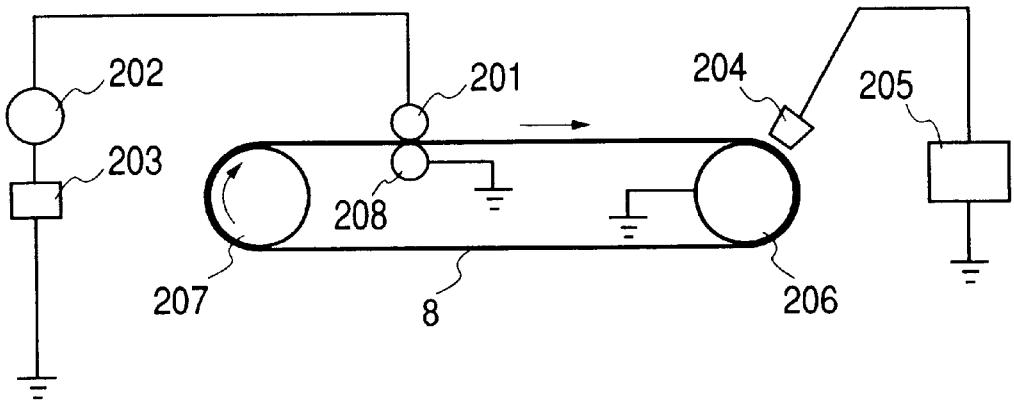
FIG. 4 is an illustration showing a measurement system for measuring charge relaxation time for an intermediate transfer member.
Figure 5:
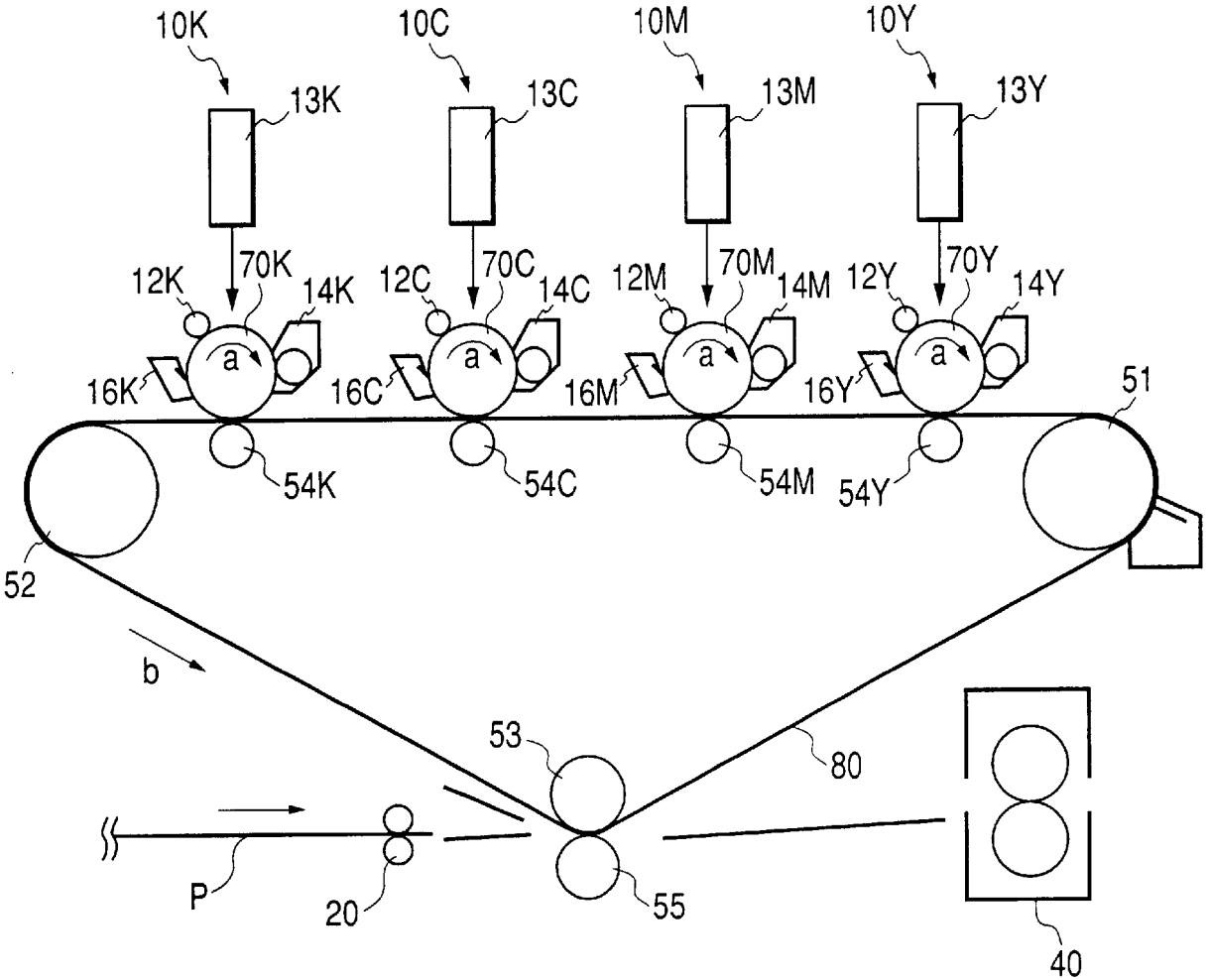
FIG. 5 is a schematic configuration diagram showing a conventional image forming apparatus.

Note here that the charge relaxation time τ refers to a value measured by an arrangement shown in FIG. 4. That is, since the charge relaxation time does not agree with a value obtained simply by multiplying an electrostatic capacitance and a resistance of the intermediate transfer belt 8, the time measured by the arrangement and approach shown in FIG. 4 is defined as "τ" in the present invention. The intermediate transfer belt 8 is stretched over a drive roller 207 and a metal tension roller 206, which are given as a measurement equipment, to be rotated in a direction indicated by the arrow at a speed of 117 mm/s. The intermediate transfer belt 8 is sandwiched between a charge roller 201 and a metal opposed roller 208 at the above-mentioned charge position, to be charged by an AC power supply 202 with a peak-to-peak voltage Vpp of about 3kV and a DC power supply 203 with Vpp of +500V.

The measurement environment included a temperature of 23° C. and a relative humidity of 60%.

Also, the voltage applied to the charge roller 201 was that which corresponds to the absolute value of a difference between a bias 300V applied to the primary transfer roller and a highlight potential of about −200V of the photosensitive drum at the time of usually forming an image in the above-mentioned environment.

Also, in this embodiment, by applying to the charge roller 201 a voltage obtained by superposing a DC voltage and an AC voltage, a portion of the intermediate transfer belt in meeting contact with the charge roller 201 is charged at approximately the same potential as the above-mentioned DC voltage, i.e. 500V. The values of Vpp and frequency of the AC voltage may be set appropriately depending on a situation.

The charge roller 201, which is of a known contact charge type, comprises an about 3 mm-thick conductive, elastic rubber layer on which is formed a medium-resistance layer with a volume resistivity of about $10^6$ Ωcm on which in turn is formed a several tens of micrometer(μm) thick adherence-preventing layer made of nylon-based resin etc., to provide a cylinder with about 12 mm.

The intermediate transfer belt 8 charged by the charge roller 201 has its surface potential W measured by a surface electrometer probe 204 and an electrometer body 205 provided at a position as rotated for T seconds from the charge position to its downstream side. The time T is supposed to be the same as a time taken for a portion of the intermediate transfer belt to pass a distance between mutually adjacent two image bearing members of an image forming apparatus of the present invention, i.e. 0.8 second.

If, in this case, the intermediate transfer belt 8 meets the following relationship:

$$W \leqq 500/e[V]$$

it is of a self-attenuating type, and if it meets the following relationship:

$$W > 500/e[V]$$

it is of a charge-up type.

In this embodiment, there were prepared two intermediate transfer belts: a charge-up type belt A and a self-attenuating type belt B, which were used in an experiment to check the properties in image forming. The results are described as follows.

The intermediate transfer belt A consists of a surface layer, an intermediate layer, and an underlying layer. The surface layer, having a volume resistivity of $1\times10^{16}$ Ωcm and a thickness of 10 μm, is made of a urethane resin into which is scattered fluorine resin PTFE with an excellent mold releasing ability. The intermediate layer has a volume resistivity of $1\times10^{10}$ Ωcm and a thickness of 10 μm and the underlying layer has a volume resistivity of $1\times10^7$ Ωcm and a thickness of 820 μm, both of which are made of rubber mainly containing NBR.EPDM mixture rubber.

The intermediate transfer belt B consists of two layers of a surface layer and an underlying layer. The surface layer, having a volume resistivity of $1\times10^{12}$ Ωcm and a thickness of 20 μm, is made of a medium-resistance urethane resin into which a lubricant is scattered. The underlying layer, having a volume resistivity of $1\times10^{6}$ Ωcm and a thickness of 1000 μm, is made of rubber mainly containing NBR.epichlorohydrin mixture rubber.

An image forming apparatus according to this embodiment can use up to an A3 size of a recording material P at the process speed of 117 mm/s.

The above-mentioned intermediate transfer belts A and B were mounted to an image forming apparatus shown in FIG. 1, to obtain optimal values of primary transfer biases Vy, Vm, Vc, and Vk applied to the primary transfer rollers 54Y, 54M, 54C, and 54K respectively so as to give good full-color images with the maximum primary transfer efficiency for the respective colors, thereby resulting in the following:

TABLE 1

(unit: V)

| | Vy | Vm | Vc | Vk |
|---|---|---|---|---|
| Intermediate transfer belt A | 240 | 560 | 700 | 750 |
| Intermediate transfer belt B | 300 | 300 | 300 | 300 |

Table 1 indicates that with the intermediate transfer belt A, the primary transfer bias can be optimized only by applying a higher transfer bias to the more downstream side image forming sections (i.e., Vy<Vm<Vc<Vk). This is because the intermediate transfer belt is gradually charged up electrically therein as it sequentially passes the image forming sections 10Y, 10M, 10C, and 10K in this order, to provide higher effective impedance in the width-wise direction of the intermediate transfer belt passing the transfer nip section as it passes the more downstream side image forming sections.

To achieve good transferability at all the image forming sections 10Y through 10K, therefore, it is necessary to set higher constant-voltage biases to the more downstream side image forming sections in order to obtain a sufficient transfer current at all the image forming sections. In addition, Table 1 indicates that since the intermediate transfer belt is charged up even more, the values of the primary transfer biases Vy, Vm, Vc, and Vk must sequentially be raised even higher according to the number of sheets to be printed consecutively.

Also, since the intermediate transfer belt is charged up even higher, the secondary transfer bias applied to the secondary transfer roller 55 using the secondary transfer-bias high-tension power supply 49 must not only be variable with various recording materials P but also be set at sequentially higher values at the time of consecutive printing even with the same kind of the recording material P.

Therefore, if a charge-up type of the intermediate transfer belt 8 is employed, control over the first and second transfer biases is complicated, thus making it difficult to always obtain a good full-color image.

With the intermediate transfer belt B, on the other hand, as indicated by Table 1, a relationship of Vy=Vm=Vc=Vk is given, so that the primary transfer bias may be of the same value for all the image forming sections 10Y through 10K. This is because the intermediate transfer belt B has a shorter lapse of relaxation time for charge built up therein, namely is of an electrically self-attenuating type having no charge-up characteristics, so that the effective impedance, at any image forming section passed by, in the belt thickness direction at the transfer nip section of the intermediate transfer belt remains as is in the initial state before the yellow image forming section 10Y is passed, thus making it possible to obtain good transferability at all the image forming sections with essentially the same primary transfer bias value. This primary transfer bias is always maintained constant even at the time of consecutive printing.

Also, the secondary transfer bias W applied to the secondary transfer roller 55 using the secondary transfer-bias high-tension power supply 49 need not be raised sequentially at the time of consecutive printing but only needs to be variable with various kinds of the recording material P.

Therefore, use of a self-attenuating type intermediate transfer belt 8 eliminates the necessity of specially providing an apparatus for initializing the potential of (i.e., discharging) the intermediate transfer belt 8 after secondary transfer and also simplifies control over the primary and secondary transfer biases to obtain good full-color images in a stable manner.

The above-mentioned detailed discussion of this embodiment has come up with a result that by providing an image forming apparatus with a self-attenuating type of the intermediate transfer belt 8, it is possible to simplify control over the primary and secondary biases for each color and also to obtain good full-color images in a stable manner.

In this embodiment, a relationship of $\tau \leqq T'$ is satisfied in which T' is a time taken in order for the intermediate transfer belt 8 to move from the secondary transfer section to the primary transfer section $T_1$. Therefore, this embodiment eliminates the necessity of providing a special discharging apparatus for discharging, i.e. initializing the intermediate transfer belt after the secondary transfer and before the primary transfer, thus making it possible to further reduce the size and the cost of the apparatus. Similarly, a relationship of $\tau \leqq T''$ is also satisfied in which T" is a time taken in order for the intermediate transfer belt to move from the primary transfer section $T_4$ to the secondary transfer section.

Also, in this embodiment, when any one of the single-color, two-color, and three-color modes is selected, to prevent a photosensitive drum from deteriorating electrically or mechanically due to its friction with the intermediate transfer belt, that photosensitive drum, if not used in image forming currently, may be appropriately spaced from the intermediate transfer belt.

Here, as the high-tension power supply for the primary and secondary transfer processes, a constant-current power supply may be employed. With such a configuration also, it is possible to reduce a voltage applied from the power supply to the primary and secondary transfer rollers, to simplify control.

Although the above embodiment employs roller-shaped primary transfer rollers 54Y through 54K and secondary transfer roller 55, blade-shaped or brush-shaped ones may be used instead in similar application of the present invention.

Second Embodiment

Figure 2:
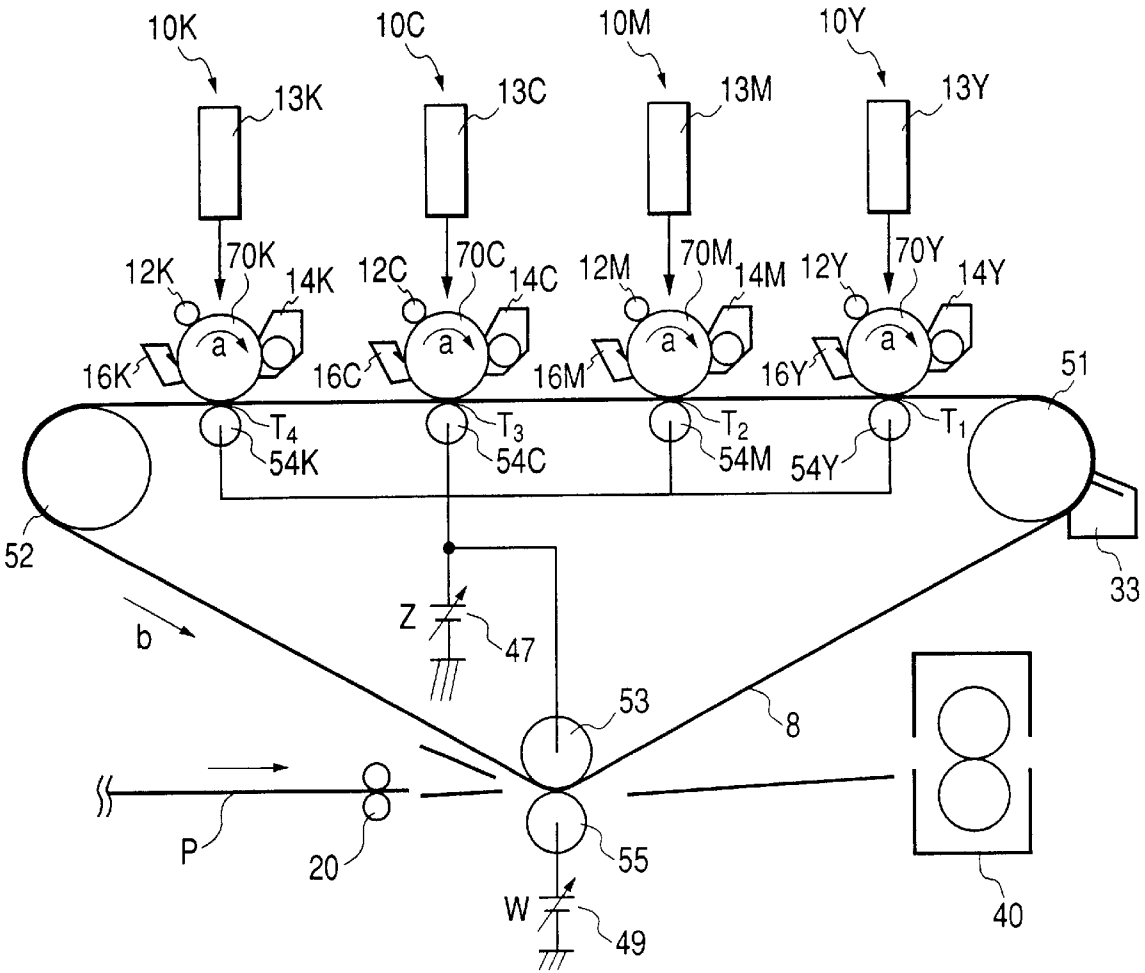
FIG. 2 is a schematic configuration diagram showing another embodiment of the image forming apparatus according to the present invention.

FIG. 2 shows a schematic configuration diagram showing another embodiment of the image forming apparatus according to the present invention.

This embodiment employs as the intermediate transfer belt 8 a self-attenuating type intermediate transfer belt B described in the first embodiment and also simplifies a high-tension power supply for controlling primary transfer biases. The other components of this embodiment's configuration are basically the same as those of the first embodiment, so their detailed description is omitted here.

In this embodiment, primary transfer rollers 54Y, 54M, 54C, and 54K of their respective image forming sections (image forming stations) of an image forming apparatus are fed with a same transfer bias Z=300V in parallel from one common high-tension power supply 47, which bias is applied also to a secondary transfer opposed roller 53 simultaneously.

A secondary transfer roller 55 is fed with a variable secondary transfer bias X according to the kind of a recording material P, from a secondary transfer-bias high-tension power supply 49. The secondary transfer bias X has a relationship of X=W+Z with W applied by the high-tension power supply 49 in the image forming apparatus according to the first embodiment.

The primary transfer high-tension power supply 47 used in this embodiment is rendered compact and inexpensive. This is because the intermediate transfer belt 8 is of a self-attenuating type, thus eliminating the necessity of changing values of the primary transfer bias Z and the secondary transfer bias X according to the number of sheets to be printed consecutively. This embodiment utilizes such simplified bias control to obtain good full-color images in a stable manner.

Also, since the primary transfer rollers 54Y through 54K and even the secondary transfer opposed roller 53 have a same potential, any undesirable leakage current can be prevented from occurring between these rollers through the internal surface of the intermediate transfer belt 8. Preferably a resistance of a back surface of the intermediate transfer belt 8 is low. Therefore, power dissipation of the high-tension power supply 47 may be controlled at a low level. Also, by always providing on/off control at the same timing over the primary transfer bias applied to the primary transfer rollers 54Y through 54K and a bias applied to the secondary transfer opposed roller 53, poor imaging due to electrical interference between the transfer sections (rollers) can be reduced.

Also, a voltage of Z=300V may be similarly applied from the high-tension power supply to a tension roller 51 and a drive roller 52. By providing such a configuration, it is possible to prevent poor imaging due to electrical interference (a shortage of the transfer current) between these rollers (i.e., primary transfer rollers, secondary transfer opposed roller, drive roller, and tension roller).

As mentioned above, this embodiment uses a self-attenuating type of the intermediate transfer belt and applies in parallel a same bias to the primary transfer rollers of the respective image forming sections using one high-tension power supply, to reduce the primary transfer high-tension power supply in size and cost, and it also applies the same bias to the secondary transfer opposed rollers, to reduce a leakage current, thus reducing the power dissipation.

Although the first and second embodiments have been described above with respect to a rubber-made belt having a plurality of layers employed as the intermediate transfer belt, a single-layer belt or resin-made one have the same effects.

Third Embodiment

Figure 3:
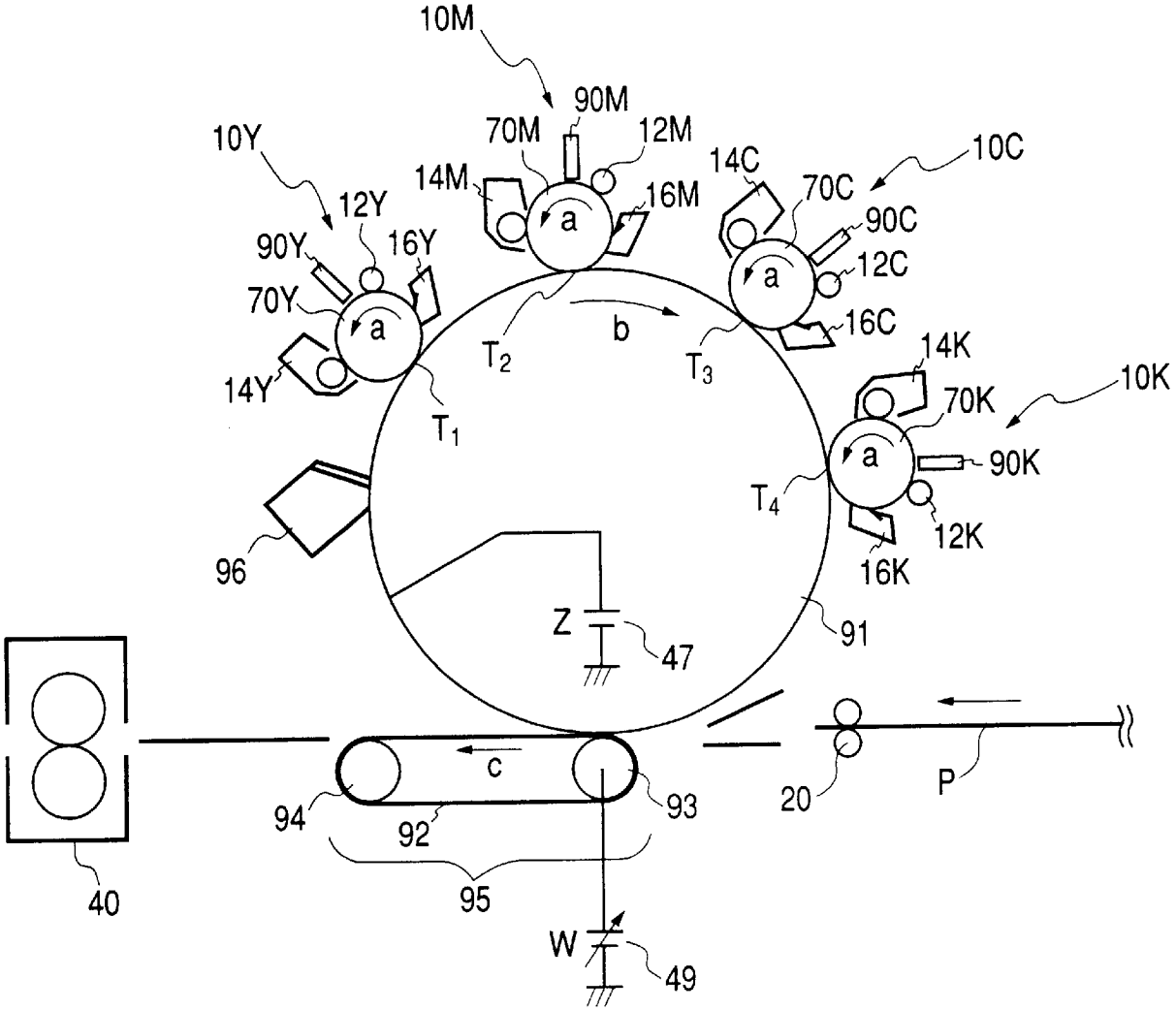
FIG. 3 is a schematic configuration diagram showing still another embodiment of the image forming apparatus according to the present invention.

FIG. 3 is a schematic configuration diagram showing still another embodiment of the image forming apparatus according to the present invention.

This embodiment uses such an intermediate transfer drum 91 in place of the intermediate transfer belt 8 used in the first embodiment shown in FIG. 1, around which intermediate transfer drum 91 are arranged four image forming sections 10Y, 10M, 10C, and 10K for four colors of yellow, magenta, cyan, and black respectively.

The image forming sections 10Y, 10M, 10C, and 10K use LED exposure devices 90Y, 90M, 90C, and 90K in place of the laser exposure devices 13Y, 13M, 13C, and 13K respectively used in the first embodiment. The other components of this embodiment are basically the same as those of the first embodiment, so the same reference symbols indicate the same members in FIGS. 1 and 3.

Like in the first embodiment, in this embodiment also, photosensitive drums 70Y, 70M, 70C, and 70K have four colors of toner images formed on their surfaces respectively at predetermined timing, which toner images are sequentially multi-transferred onto the intermediate transfer drum 91 at the respective primary transfer sections each consisting of each of the photosensitive drums 70Y through 70K and the intermediate transfer drum 91.

According to this embodiment, the intermediate transfer drum 91 has a diameter of 186 mm and a width (axial length) of 310 mm, comprising an aluminum-made metal core onto which is formed a 5 mm-thick conductive rubber layer which in turn is coated with a surface layer having a thickness of 20 $\mu$m, to provide a so-called solid-drum shaped one. The conductive rubber layer is made of rubber mainly containing NBR.epi-chlorohydrin mixture rubber, being regulated to a volume resistivity of $1\times10^{6}$ Ωcm. The surface layer is made of a medium-resistance urethane resin into which a lubricant is scattered, having a volume resistivity of $1\times10^{12}$ Ωcm. The aluminum-made metal core of the intermediate transfer drum is fed via a feeder spring (not shown) with a primary transfer bias of 300V from a high-tension power supply 47.

The four colors of toner images primary-transferred in superposition onto the intermediate transfer drum 91 are collectively transferred electrostatically onto a recording material P conveyed at predetermined timing, by a secondary transfer device 95 which forms, in meeting contact with the intermediate transfer drum 91, a secondary transfer nip section (secondary transfer).

The secondary transfer device 95 in this embodiment is configured in such a manner that a secondary transfer belt 92 is stretched over a secondary transfer roller 93 and a drive roller 94. The secondary transfer device 95 is disposed in such a way that the secondary transfer roller 93 provided on the upstream side in a direction of converting the recording material P may meet in contact with the intermediate transfer drum 91 via the secondary transfer belt 92. The drive roller 94 drives in rotation the secondary transfer belt 92 in a direction indicated by the arrow c so that the intermediate transfer drum 91 and the secondary transfer belt 92 may have a same peripheral speed.

Also, the secondary transfer device 95 is arranged so as to come in contact with and separate from the intermediate transfer drum 91, so that the secondary transfer device 95 abuts against the intermediate transfer drum 91 via the recording material P on secondary transfer. The abutting pressure is 3.2 kgf. Also, to a metal core portion of the secondary transfer roller 93 is applied from a high-tension power supply 49 a secondary transfer bias W changing with, for example, various kinds of the recording material P, to electrostatically transfer a toner image from the intermediate transfer drum 91 onto the recording material P. By thus applying the secondary transfer bias, a secondary transfer current flows in a direction from the secondary transfer roller 93 to the intermediate transfer drum 91, to feed charge in a direction from the secondary transfer belt 92 to the recording material P, thus secondary-transferring the toner image on the intermediate transfer drum 91 onto the recording material P.

The secondary transfer roller 93 and the secondary transfer belt drive roller 94 each consists of a roller having a 14 mm-diameter metal core which is coated with a conductive rubber layer with a volume resistivity of $1\times10^5$ Ωcm for a longitudinal length of 310 mm so as to provide a diameter of 20 mm. The secondary transfer roller 93 has its metal core connected via a feeder spring to the high-tension power supply, to follow the secondary transfer belt 92 in rotation. The secondary transfer belt drive roller 94 is driven when driving force is transferred thereto from a drive mechanism (not shown).

The secondary transfer belt 92, which is a seamless belt with a width of 310 mm and an internal diameter of 65 mm, is stretched, with a 5% expansion, over the secondary transfer roller 93 and the secondary transfer belt drive roller 94 arranged with an axis-to-axis distance of 77.5 mm therebetween. The secondary transfer belt 92, having a thickness of 310 μm, comprises a 20 μm-thick surface layer made of PTFE-based rubber and a 290 μm-thick underlying layer made of an elastomer to which carbon is scattered. The underlying layer has a volume resistivity of $1\times10^6$ Ωcm, so the transfer belt has on its surface a measurement value of a surface resistivity of $1\times10^{12}$ Ωcm.

In this embodiment, the secondary transfer device 95 electrostatically transfers a toner image onto the recording material P and absorbs the recording material P onto the secondary transfer belt 92 electrostatically and then separates the recording material P from the surface of the intermediate transfer drum 91. Here, the secondary transfer device 95 may be configured with a single transfer roller.

As described above, the recording material P having the toner image transferred thereon is conveyed to a fixing device 40 where the toner is permanently fixed onto the recording material P with heat and pressure, and is then ejected out of the image forming apparatus. Residual secondary transfer toner left on the surface of the intermediate transfer drum 90 after completion of the secondary transfer is removed and collected by a drum cleaner 96.

Since it has the intermediate transfer drum 91 with a diameter of 186 mm, the image forming apparatus according to the present invention can use the recording material P of up to A3-size sheets of paper to be passed through. The image forming apparatus has a process speed of 117 mm/s.

The primary transfer bias in this embodiment is 300V, which is applied via a feeder spring to the cylindrical aluminum-made metal core of the intermediate transfer drum 91, so that the primary transfer bias of 300V is applied uniformly to all the primary transfer sections. Since the intermediate transfer drum 91 used in this embodiment is also of a self-attenuating type electrically, this bias setting makes it possible to always obtain good transferability at all the image forming sections as well as good full-color images in a stable manner.

Also, whether this intermediate transfer drum is of a self-attenuating type or not can be decided by the same device as that shown in FIG. 4.

This embodiment uses LED exposure devices in place of laser exposure devices and also employs an intermediate transfer drum as the intermediate transfer member, thus further improving color registration as compared to the image forming apparatus of the first and second embodiments. The LED exposure device, as compared to a laser exposure device, is excellent in terms of color registration in the main scanning direction, reducing a shift of images in the main scanning direction. The LED exposure device contributes to compacting of the image forming sections 10Y through 10K.

Moreover, the concept of an intermediate transfer member generally has an advantage of color registration due to a thickness of the recording material being unlikely to occur, which advantage may further be enhanced by use of an intermediate transfer drum.

As described above, this embodiment uses a self-attenuating type intermediate transfer drum as the intermediate transfer member and also employs an LED exposure device as the exposure device, thus compacting various colors of image forming sections and obtaining full-color images excellent in color registration.

Since in the above embodiments a relationship of $\tau \leqq T$ is established, by the time when the intermediate transfer belt arrives at the next primary transfer section, a residual potential of the intermediate transfer belt decreases enough to be stable, thus making it possible to perform the next primary transfer process in a desirable manner.

Also, since the relationship of $\tau \leqq T$ is established even when a potential contrast of a highlight (potential: $V_L$) and a shadow (potential: $V_D$) on the photosensitive drum is formed on the surface of the intermediate transfer belt at the time of the primary transfer, this potential contrast is eliminated (initialized) by the time when the intermediate transfer belt arrives at the next primary transfer section, thus making it possible to form a half-tone image in a desirable manner.

What is claimed is:

1. An image forming apparatus comprising:

a plurality of image bearing members for bearing a plurality of images; and an intermediate transfer member onto which the plurality of images on the plurality of image bearing members are sequentially and electrostatically transferred at respective transfer positions, the plurality of images on the intermediate transfer member being transferred onto a recording material, wherein the following relationship is satisfied:

$$\tau \leqq T$$

in which T (second) is a time taken in order for the intermediate transfer member to move from one transfer position to an adjacent transfer position when the plurality of images are transferred from the plurality of image bearing members onto the intermediate transfer member, and τ (second) is a charge relaxation time of the intermediate transfer member, and wherein the charge relaxation time τ is defined as a time taken until a potential of the intermediate transfer member charged to a potential V by charging means lowers to V/e (e is a base of natural logarithm and is 2.71828 . . . ).

2. The image forming apparatus according to claim 1, wherein when the intermediate transfer member is charged to the potential V by the charging means, a voltage obtained by superposing a DC voltage and an AC voltage is applied to the charging means.

3. The image forming apparatus according to claim 2, further comprising a plurality of transfer means which are provided on a side opposite to a side of the intermediate transfer member on which the images are transferred and which electrostatically transfer a plurality of images from the plurality of image bearing members onto the intermediate transfer member at the transfer positions respectively, the DC voltage being essentially equal to an absolute value of a difference between a potential of the image bearing member as exposed to a light and a voltage applied to the transfer means at a time of image transfer.

4. The image forming apparatus according to claim 1, wherein the time T (second) is a time taken in order for the intermediate transfer member to move from one transfer position to an adjacent transfer position.

5. The image forming apparatus according to claim 1, further comprising a plurality of transfer means which are provided on a side opposite to a side of the intermediate transfer member on which the images are transferred and which electrostatically transfer a plurality of images from the plurality of image bearing members onto the intermediate transfer member at the transfer positions.

6. The image forming apparatus according to claim 5, wherein essentially a same voltage is applied to the plurality of transfer means at a time of image transfer.

7. The image forming apparatus according to claim 6, wherein a voltage applied to the plurality of transfer means at a time of image transfer is controlled to a constant voltage.

8. The image forming apparatus according to claim 6, or 7, further comprising a plurality of power supplies for applying voltages to the plurality of transfer means respectively at a time of image transfer.

9. The image forming apparatus according to claim 6 or 7, further comprising a single power supply for applying a voltage to the plurality of transfer means.

10. The image forming apparatus according to claim 1, wherein the intermediate transfer member is a belt which is supported by a plurality of support means.

11. The image forming apparatus according to claim 1, wherein a plurality of colors of images are sequentially transferred in a superposition state from the plurality of image bearing members onto the intermediate transfer member, and the plurality of colors of images on the intermediate transfer member are then transferred onto a recording material.

12. An image forming apparatus comprising:

a plurality of image bearing members for bearing a plurality of images; and an intermediate transfer member onto which the plurality of images on the plurality of image bearing members are sequentially and electrostatically transferred at respective transfer positions, the plurality of images on the intermediate transfer member being transferred onto a recording material, wherein the following relationship is satisfied:

$$\tau \leqq T$$

in which T (second) is a time taken in order for the intermediate transfer member to move from one transfer position to an adjacent transfer position when the plurality of images are transferred from the plurality of image bearing members onto the intermediate transfer member, and $\tau$ (second) is a charge relaxation time of the intermediate transfer member, and wherein a relationship $\tau \leqq T'$ is satisfied in which T' is a time taken in order for the intermediate transfer member to move from a position where the plurality of images on the intermediate transfer member are transferred to the recording material to a position where an image is first transferred onto the intermediate transfer member.

13. An image forming apparatus comprising:

a plurality of image bearing members for bearing a plurality of images; and an intermediate transfer member onto which the plurality of images on the plurality of image bearing members are sequentially and electrostatically transferred at respective transfer positions, the plurality of images on the intermediate transfer member being transferred onto a recording material, wherein the following relationship is satisfied:

$$\tau \leqq T$$

in which T (second) is a time taken in order for the intermediate transfer member to move from one transfer position to an adjacent transfer position when the plurality of images are transferred from the plurality of image bearing members onto the intermediate transfer member, and $\tau$ (second) is a charge relaxation time of the intermediate transfer member, and wherein a relationship of $\tau \leqq T''$ is satisfied in which T" is a time taken in order for the intermediate transfer member to move from a position where a last image is transferred onto the intermediate transfer member to a position where the plurality of images on the intermediate transfer member are transferred onto a recording material.

* * * * *